United States Patent [19]

Hadary

[11] 4,106,152

[45] Aug. 15, 1978

[54] TOOTHBRUSH

[76] Inventor: Joseph Hadary, 5405 Linden Ct., Bethesda, Md. 20014

[21] Appl. No.: 788,938

[22] Filed: Apr. 19, 1977

Related U.S. Application Data

[63] Continuation-in-part of Ser. No. 674,438, Apr. 7, 1976, Pat. No. 4,033,007, which is a continuation-in-part of Ser. No. 564,074, Apr. 1, 1975, Pat. No. 3,994,039.

[51] Int. Cl.[2] ..... A46B 9/10

[52] U.S. Cl. ..... 15/172; 15/176; 30/339

[58] Field of Search ..... 15/172, 176, 184, 185; 30/329, 336, 337, 338, 339; 132/90; 128/305

[56] References Cited

U.S. PATENT DOCUMENTS

| | | | |
|---|---|---|---|
| 2,032,664 | 3/1936 | Raptis | 15/172 |
| 3,367,335 | 2/1968 | Ward et al. | 30/329 X |
| 3,886,618 | 6/1975 | Paoletti | 15/172 |
| 3,927,435 | 12/1975 | Moret et al. | 15/176 |

*Primary Examiner*—George F. Mautz
*Attorney, Agent, or Firm*—Dennis H. Lambert

[57] ABSTRACT

A toothbrush having an elongate handle with an enlarged base end capable of supporting the toothbrush in an upright position and being hollow for storage of the bristle head or the like therein, includes an elongate shaft fixed at one end to the base and projecting axially therefrom. A tubular sleeve is axially slidable on the shaft and the shaft has bristle head retaining structure thereon for retaining a bristle head on the handle at the end thereof opposite the base end. The sleeve is normally biased toward the base end to a first position, whereat the bristle head retaining structure is engaged with the bristle head to hold it in position and the sleeve is movable away from the base end to a second position to move the bristle head to disengage it from the bristle head retaining structure. A finger operated sleeve actuator is slidable relative to the base end and shaft to engage the sleeve and move it to its second position, and a seal is engaged between the shaft and sleeve at the bristle head end.

10 Claims, 7 Drawing Figures

TOOTHBRUSH

BACKGROUND OF THE INVENTION

This application is a continuation-in-part application of Ser. No. 674,438, filed Apr. 7, 1976, now U.S. Pat. No. 4,033,007, which is, in turn, a continuation-in-part of application Ser. No. 564,074, filed Apr. 1, 1975, and now U.S. Pat. No. 3,994,039.

This invention relates to dental equipment for promoting oral hygiene and, in particular, relates to a unique and improved toothbrush for effecting more thorough cleansing of teeth and gum areas near the base of the teeth. With prior art toothbrushes it is very difficult to effectively clean the gingival margins and sulcus areas, particularly in difficult to reach portions of the mouth, because of the fixed relationship of the bristles to the handle, and also due to the large size of the bristles and handle. Further, the construction of prior art toothbrushes makes it necessary to tilt the handle both horizontally and vertically in order to reach certain areas of the teeth.

The importance of cleaning not only the tooth surfaces, but also of cleaning the gingival crevice and of massaging the gums is clearly evident when it is recognized that diseases of the gums, such as gingivitis, for example, afflict approximately 65% of the nations' school children, and in adults, at the age of 40 for example, nearly 100% have some form of tooth or gum disease. If the teeth were properly cleaned, the bacteria which cause tooth and gum diseases could be significantly reduced, if not eliminated, and the incidence of disease reduced accordingly.

One of the most common and widely used dental instruments for cleaning the teeth and gums is the toothbrush, but unfortunately, for the reasons suggested above, the toothbrush is not frequently used correctly, and according to one report ("Toothbrushing — the Hoax of American Dentistry, " Robert F. Barkley, *Arizona Dental Journal,* 1967), the toothbrush and its use is probably responsible for only a 10% reduction in tooth and gum diseases.

In this connection, there are many widely recognized and proven methods of using a toothbrush, and such methods include the vertical, rolling, Fones, Stillman and Charters methods. Whichever method used, it is desirable to thoroughly clean the interproximal areas of the teeth, as well as the buccal and lingual surfaces, and the sulcus areas at the base of the teeth. Also the occlusal surfaces of the teeth should be thoroughly cleaned. However, due to the natural arc of the teeth, and the fact that the teeth have both concave and convex surfaces and the teeth are of different sizes, on both upper and lower jaws, and teeth are frequently malposed, all tooth surfaces are usually not effectively cleaned. Also, the buccal surfaces of the posterior teeth are particularly difficult to clean because of the inward pressure of the cheek against these teeth.

Many attempts have been made in the prior art to devise a toothbrush capable of performing satisfactorily all of the above functions. However, most efforts in this regard have been directed toward different bristle configurations, whereby the bristles are constructed such that they more readily enter the interproximal areas or the gingival margins at the base of the teeth. However, even with such prior art constructions, it is very difficult to reach the lingual surfaces of the lower anterior teeth, and the buccal surfaces and gingival crevice of the posterior teeth. For example, when attempting to brush the lingual surfaces of the lower anterior teeth, it is necessary with prior art toothbrush constructions to elevate the handle of the toothbrush in order that access of the bristles to the lingual surfaces of the anterior teeth can be gained. This, of course, is awkward for anyone to do, and is particularly difficult for persons suffering from arthritis or other ailments which renders it difficult for them to elevate their arms above certain positions, and it is also difficult for children to manipulate the handle in a proper manner to gain proper access to the various surfaces of the teeth. Consequently, such persons, including small children, frequently do not brush the difficult to reach surfaces of the teeth, and the incidence of disease is thereby increased.

The toothbrush according to the present invention is relatively small in comparison with conventional prior art toothbrushes, and may be easily carried in the pocket or the like for use away from home. Further, the base of the handle of the present toothbrush enables the toothbrush to be free standing, thus avoiding the hygienic problems encountered due to laying a conventional toothbrush on an unclean surface, or supporting it from a holder or the like.

Additionally, the bristle head of the toothbrush of the invention is small in size, thus making it easier to use to reach relatively inaccessible areas of the mouth. Further, with the toothbrush of the invention, the small, replaceable bristle head can easily be replaced and it is not necessary to replace the whole toothbrush, as with prior art toothbrushes.

Further, the toothbrush of the invention is improved over prior art toothbrushes, in that it may be held in one hand and a sleeve actuator manipulated with a finger to disengage the bristle head retaining means and enable release of the bristle head.

OBJECTS OF THE INVENTION

Accordingly, it is an object of this invention to provide a toothbrush having a unique construction which provides for easy access of the bristles to all of the surface areas of the teeth in a person's mouth.

Another object of the invention is to provide a toothbrush having a pivotal head carried by the handle thereof, such that the head may be pivoted to a plurality of positions, and in said positions, access to the various surfaces of the teeth on opposite sides, respectively, of the mouth is greatly enhanced, and wherein the handle is small and is configured whereby it may be readily grasped and manipulated with the fingers, thus rendering it much easier for all persons, and particularly infirm persons or small children, to gain access to those areas of the teeth.

A still further object of the invention is to provide a toothbrush having a removable head and bristles thereon, whereby heads having different bristle configurations can be quickly and easily attached to the handle for providing the best bristle configuration for particular cleaning operations to be performed on the teeth and gums, such as, for example, small bristle heads for reaching confined areas in the mouth.

Yet another object of the invention is to provide a toothbrush having a pivotally mounted head and bristle arrangement, wherein the handle of the toothbrush has a hollow storage compartment therein and is enlarged such as to be self-supporting in an upright, free standing position.

An additional object of the invention is to provide a toothbrush having a releasable and adjustable bristle head, and wherein the toothbrush may be held in one hand and manipulated to free the bristle head.

DETAILED DESCRIPTION OF THE INVENTION

Figure 1:
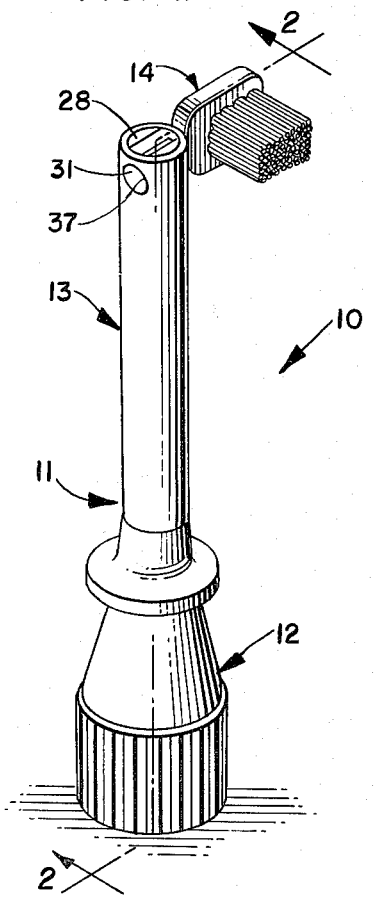
FIG. 1 is a perspective view of a toothbrush in accordance with the invention.

In the drawings, wherein like reference numerals indicate like parts throughout the several views, a toothbrush in accordance with the invention is indicated generally at 10 and comprises an elongate handle 11 having an enlarged hollow base 12 thereon and an elongate tubular forward end 13 axially slidable relative to the base end 12. A bristle head configuration 14 is releasably connected to the upper or distal end of the forward end portion 13 of the handle 11.

The base end 12 comprises a first, cylindrical portion 15 terminating in an open end 16 and having threads 17 thereon adjacent the upper or forward end thereof. The cylindrical portion 15 joins with a frusto-conical portion 18 which terminates at its upper end in an annular shoulder 19. The base end has an integral upstanding stub 20 internally threaded at 21. A cup-shaped cap 22 is threaded onto the base end in closing relationship to the open end 16 thereof and defines with the hollow base end a chamber or cavity 23 in which a bristle head or the like 14 may be stored. An elongate shaft 24 has a lower reduced diameter threaded end 25 threadably engaged in the threaded bore 21 of the base end 12 supporting the shaft thereon. The shaft has an enlarged upper end 26 defining an axially downwardly or rearwardly facing shoulder 27 and the extreme upper or distal end of the enlarged end portion 26 is bifurcated at 28 and has a centrally located, axially projecting pin 29 between the legs of the bifurcated end 28 for engaging in the recesses 30 of shaft 31 of bristle head 14 to retain the bristle head in any one of a plurality of rotatably adjusted positions.

A tubular sleeve 32 is axially slidably received on the shaft 24 and has an enlarged diameter internal bore 33 at the upper or forward end thereof defining an axially upwardly or forwardly facing shoulder 34. A coil spring 35 is received in the enlarged bore portion 33 and is engaged at one end with the shoulder 34 on the sleeve 32 and at the other end with the shoulder 27 on the enlarged end portion 26 of shaft 24. An O-ring seal 36 is engaged between the shaft and sleeve to prevent entry of fluid and the like into the space between the shaft and sleeve. A pair of aligned openings 37 and 38 are formed through the sleeve at the upper end thereof through which the shaft 31 of the bristle head 14 is received.

A guide channel or slot 39 is formed in one side of the shaft 24 adjacent the base 12 and a pin 40 is extended inwardly from the bottom or rearward end of sleeve 32 into the channel 39 for enabling relative axial movement between the sleeve and shaft, but preventing relative rotational movement therebetween.

Figure 6:
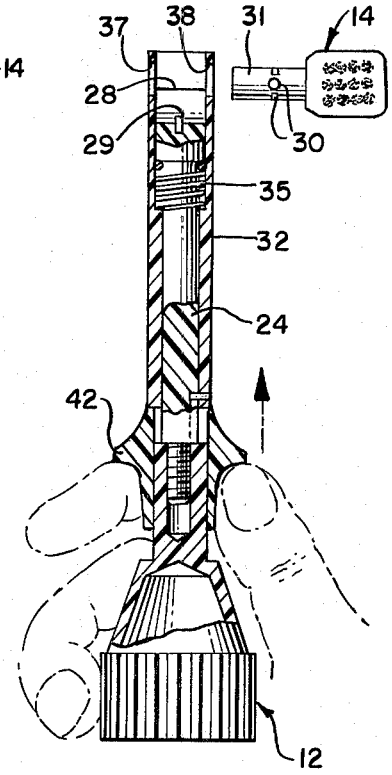
FIG. 6 is a view similar to FIG. 2 showing the manner in which the sleeve is actuated to release the bristle head.
Figure 3:
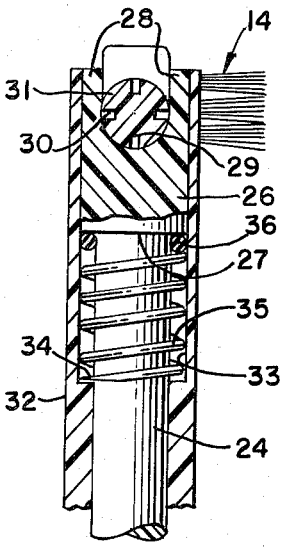
FIG. 3 is an enlarged fragmentary view in section taken along line 3—3 in FIG. 2.
Figure 4:
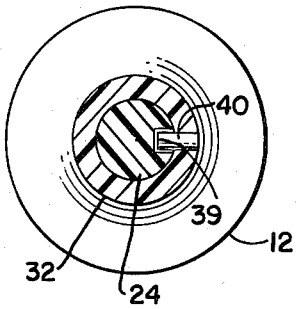
FIG. 4 is an enlarged view in section taken along line 4—4 in FIG. 2.

As seen in FIGS. 4 and 6, the sleeve 32 has a slightly larger diameter than the diameter of the upstanding portion 20 of base end 12, thereby defining an axially rearwardly or downwardly facing shoulder 41. A thumb engaging portion or sleeve actuator 42 is slidable on the reduced diameter portion 20 of base 12 between the shoulder 19 and shoulder 41, whereby the toothbrush may be held in one hand, as indicated in FIG. 6, and the finger or thumb engaged with the thumb engaging portion 42, while the enlarged base end 12 is held with the remaining fingers, to push the sleeve 32 axially upwardly to free the pin 29 from the openings 30 in the stem 31 of bristle head 14, enabling the bristle head 14 to be pulled out of the openings 37 and 38 and releasing it from the handle. Upon release of the sleeve actuator 42, the spring 35 will urge the sleeve and actuator rearwardly to the position shown in FIG. 2.

Figure 5:
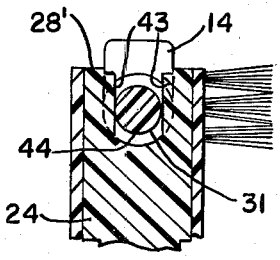
FIG. 5 is an enlarged fragmentary view in section taken at right angles to FIG. 3 and showing the interengaging means between the shaft and bristle head.

As seen in FIG. 5, the bifurcated end 28' of shaft 24 may have a plurality of axially extending ribs 43 thereon for cooperation with circumferential channels or slots 44 in the shaft 31 of bristle head 14 to retain the bristle head in position on the handle. It should be understood that although it is not shown in this figure, this form of the invention also has a locking pin 29 for cooperation with the bristle head shaft. Thus, when the locking pin is disengaged from one of the recesses 30 in the bristle head shaft, the ribs 43 engaged in the channels or slots 44 prevent the bristle head shaft from falling out of the openings 37 and 38. A slight additional forward or outward movement of the sleeve 32, however, disengages the ribs from the channels to enable the bristle head to be removed from the handle.

Figure 7:
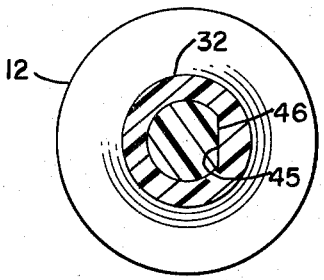
FIG. 7 is a view similar to FIG. 4 of a modified means for preventing relative rotation between the sleeve and shaft.

Moreover, in FIG. 7 an alternate means of preventing relative rotation between the sleeve 32 and shaft 24 is indicated as comprising cooperating flats 45 and 46 on the sleeve and shaft, respectively.

Figure 2:
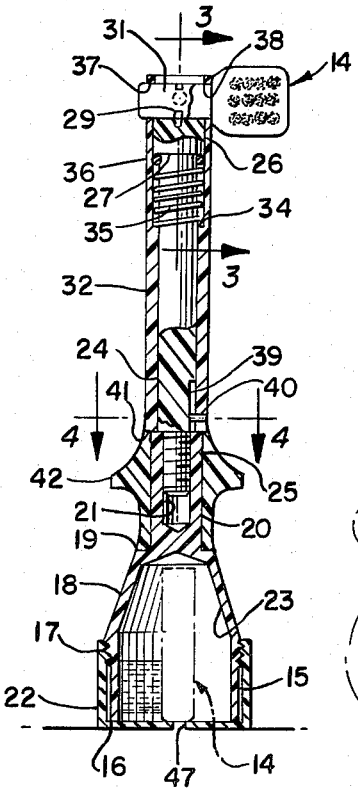
FIG. 2 is a vertical sectional view taken along line 2—2 in FIG. 1.

The components comprising the toothbrush of the present invention may be made of any suitable material, such as plastic or the like, and as seen in FIG. 2, a vent 47 may be provided in the end of cap 22, if desired, in order to enable a bristle head or the like stored therein to dry.

Further, as with applicant's previous toothbrush constructions, the toothbrush of the present invention may be completely disassembled for cleaning, repair or replacement of various parts without requiring the use of any special tools or the like.

As this invention may be embodied in several forms without departing from the spirit or essential characteristics thereof, the present embodiment is, therefore, illustrative and not restrictive, since the scope of the invention is defined by the appended claims rather than by the description preceding them, and all changes that fall within the metes and bounds of the claims or that form their functional as well as conjointly cooperative equivalents are, therefore, intended to be embraced by those claims.

I claim:

1. A toothbrush, comprising: an elongate handle means having opposite end portions, one of said end portions comprising a hollow, diametrically enlarged base capable of supporting the toothbrush in an upright position and of a size to receive and store a bristle head therein, the other end of the handle means including an elongate shaft fixed at one end thereof to one end of the base and extending axially therefrom; a sleeve telescopically received over the shaft and axially slidable relative thereto, said sleeve and shaft being approximately the same length; a bristle head adjustably carried by the handle means at said other end thereof and including a bristle head shaft projecting therefrom, said bristle head shaft extending at approximately a right angle to the axis of the handle means and releasably adjustably engaged with the handle means to support the bristle head in adjusted positions on the handle means; bristles on the bristle head extending in a direction mutually perpendicular to the axis of the handle means and the axis of the bristle head shaft; and a thumb engaging sleeve actuator axially slidable on the handle means for engaging and moving the sleeve axially to release the bristle head.

2. A toothbrush as in claim 1, wherein a spring means is engaged between the shaft and sleeve normally urging the sleeve in a first direction toward the base to maintain the bristle head in one of its adjusted positions, said sleeve actuator comprising a tubular sleeve member slidable on an extended part of the base.

3. A toothbrush as in claim 1, wherein an O-ring seal is engaged between the shaft and sleeve at said other end.

4. A toothbrush as in claim 1, wherein interengaging guide means is on the shaft and sleeve enabling relative axial movement therebetween, but preventing relative rotational movement.

5. A toothbrush as in claim 1, wherein the shaft is threadably engaged with the base to enable disassembly thereof, said sleeve actuator, sleeve and bristle head all being separable from one another upon separation of the shaft from the base.

6. A toothbrush as in claim 1, wherein a removable closure cap is engaged on the base to retain a bristle head or the like in the hollow base.

7. A toothbrush as in claim 6, wherein the closure cap has a vent opening therethrough to enable drying of a bristle head or the like placed in the hollow base.

8. A toothbrush as in claim 1, wherein a spring means is engaged between the shaft and sleeve normally urging the sleeve in a first direction toward the base to maintain the bristle head in one of its adjusted positions, said sleeve actuator comprising a tubular sleeve member slidable on an extended part of the base, an O-ring seal engaged between the shaft and sleeve at said other end and interengaging guide means on the shaft and sleeve enabling relative axial movement therebetween, but preventing relative rotational movement.

9. A toothbrush as in claim 8, wherein the shaft has bristle head retaining means thereon engageable with the bristle head to retain it on the handle.

10. A toothbrush as in claim 9, wherein the bristle head retaining means comprises a bifurcated end on the shaft, an axially projecting pin on the bifurcated end engageable in recesses on the bristle head shaft and cooperating ribs and channels on the bifurcated end and on the bristle head shaft to prevent the bristle head shaft from becoming separated from the handle when the pin is disengaged to enable adjustment of the bristle head.

* * * * *